United States Patent [19]

Bonetti et al.

[11] Patent Number: 4,574,524

[45] Date of Patent: Mar. 11, 1986

[54] APPARATUS FOR OPENING ALIGNED SLIDING DOORS OF FURNITURE

[75] Inventors: Massimo Bonetti, Padua; Giuseppe Manente, Venezia-Mestre; Abramo Mion, Mirano-Zianigo, all of Italy

[73] Assignee: KAIROS S.n.c. di Bonetti M, Manente G. e Mion A., Mirano-Zianiga, Italy

[21] Appl. No.: 647,136

[22] Filed: Sep. 4, 1984

[30] Foreign Application Priority Data

Sep. 6, 1983 [IT] Italy ..... 41601 A/83

[51] Int. Cl.[4] ..... E05D 15/20

[52] U.S. Cl. ..... 49/130; 312/138 R

[58] Field of Search ..... 49/130, 127, 129, 128; 312/138 R

[56] References Cited

U.S. PATENT DOCUMENTS 3,280,506 10/1966 Saudek et al. ..... 49/130

3,293,801 12/1966 Henning ..... 49/130

3,417,509 12/1968 Sherron ..... 49/130

*Primary Examiner*—Philip C. Kannan

*Attorney, Agent, or Firm*—Karl F. Ross; Herbert Dubno

[57] ABSTRACT

Apparatus for opening aligned sliding leaves of furniture, wherein the or each sliding leaf comprises, at its upper part, an upper track for receiving a first roller having a vertical axis and connected to a movable part of a slide guide fixedly secured to or integral with the furniture. The movable part is movable in a direction substantially perpendicular to the plane of the leaf and is provided with an engagement member, such as a pin, coupled with a first pulley connected, by means of an inextensible, flexible element, to a second pulley in a lower part of the furniture. The second pulley is supported by a horizontal shaft extending across the width of the door leaf and is provided at its ends with a pair of arms, acting upon lateral trolleys supported by pairs of rollers sliding in guides rigidly secured to the furniture. The trolleys carry a U-section member in which run horizontal-axis second rollers and vertical-axis third rollers, rigidly connected to the door leaf by means of a lower support member. On the lower member are also mounted fourth rollers arranged, when the leaf is moved perpendicular to the plane and in a direction away from the furniture, to cooperate with a horizontal lower track mounted parallel to the front surface of the furniture.

10 Claims, 14 Drawing Figures

1
2
3

1
7
10
2
15
7
3

1
7
10
15
7
3
2

1
10
7
2
7
3
15

1
7
2
3
7
10
15

APPARATUS FOR OPENING ALIGNED SLIDING DOORS OF FURNITURE

FIELD OF THE INVENTION

The present invention relates to an opening device for a sliding leaf, such as a door or window, of furniture, which provides that the leaves are mutually aligned in the closed position whereas on opening they become disposed in two different planes, by means of two perpendicular relative movements.

It is known that "sliding" door leaves of furniture are provided with opening and closing movements causing them to slide on parallel guides, with the result that they are always in a mutually non-aligned position, being movable in two different planes, which can lead to an imperfect seal against dust and an aesthetic appearance which may not be especially pleasing.

SUMMARY OF THE INVENTION

By the adoption of the present invention, the sliding leaves of furniture are aligned in the same plane when in the closed position, so as to present a substantially uniform surface and to provide a better closure, which substantially reduces or prevents dust from entering the internal space of the furniture. This is obtained by means of a guide mechanism for the leaves, which permits firstly a perpendicular displacement, and then a parallel displacement with respect to the front of the furniture, when moving from the closed position into the open position and vice versa, so that they are in a superimposed position when in the open situation and in an aligned position when in the closed position.

The sliding of the leaves parallel to the front of the furniture is assured by two pairs of rollers and an upper guide, whereas the perpendicular displacement is facilitated by two other pairs of guide rollers, a system of sheaves and cables and an upper guide.

Other aspects of the invention will become apparent in the further course of this disclosure, and no limitation whatever is intended by this summary of the invention in any respect.

BRIEF DESCRIPTION OF THE DRAWINGS

The invention will now be described with reference to the accompanying drawings relating, by way of example, to a piece of furniture having two door leaves, in which.

DETAILED DESCRIPTION OF THE DRAWINGS

Figures 1, 2, 3, 4, 5:
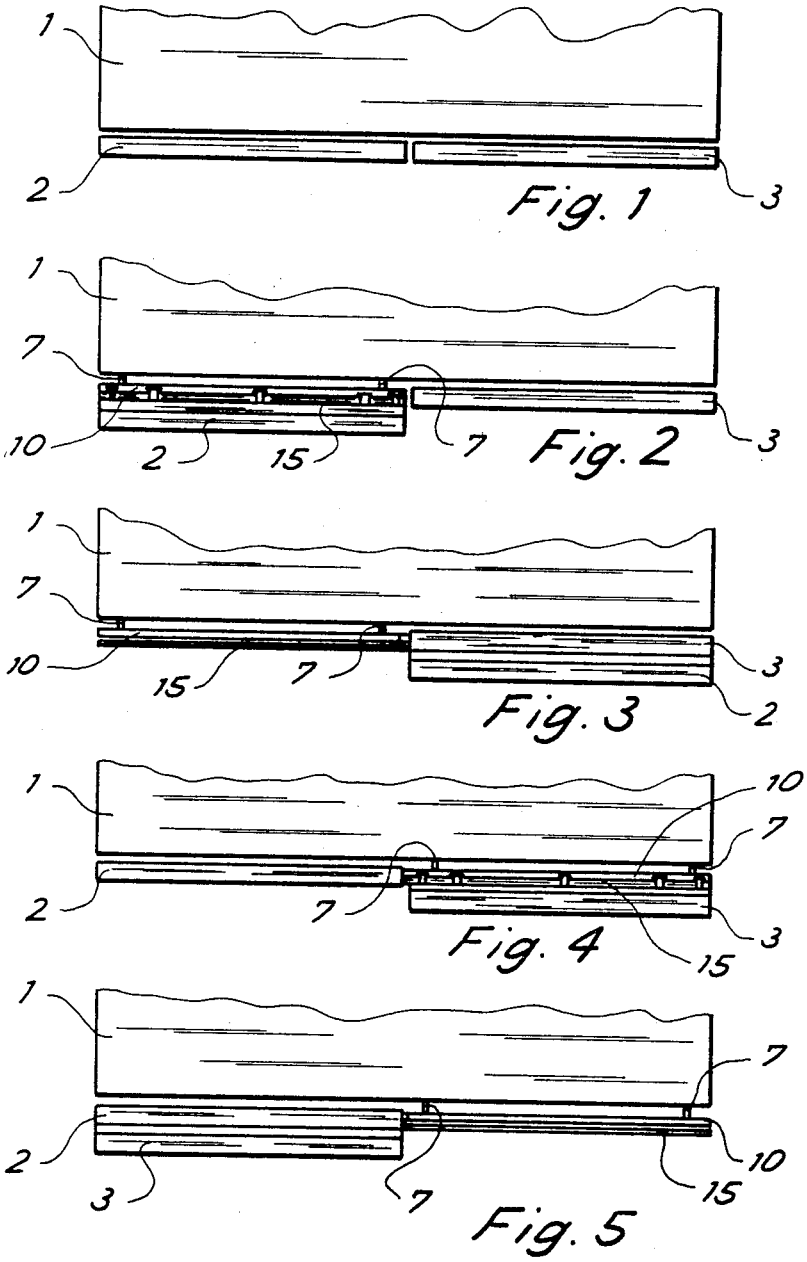
FIGS. 1, 2 and 3 represent schematically, in plan, a cupboard having two door leaves, with the left-hand door leaf in three successive positions of translation from left to right.
FIGS. 4 and 5 show two successive positions in the translation towards the left of the right-hand leaf of the cupboard of FIG. 1.

The device of this invention enables a piece of furniture equipped with multiple sliding doors to be opened in such a way as to move from their aligned position of closure to the superimposed position when open, by acting simply upon any zone of the leaf selected for opening. This applies also for the phase of closing the leaf.

As shown in the Figures, a cupboard 1, shown diagrammatically, is equipped with several leaves, two leaves 2 and 3 of which being shown.

In the upper part of each of the leaves 2, 3 there is a U-section sliding profile or channel 4, which is engaged by a roller 5 mounted on an extending guide 6, this guide having a fixed part **6*a* integral with the structure of the cupboard 1 and a movable part 6*b*, slidable upon the aforementioned part and carrying the roller 5**.

Associated with the lower part of the leaves 2, 3, are two lateral trolleys 7, each carrying a pair of grooved rollers 8 rotatable on guide profile members 9 integral with the structure of the cupboard, in correspondence with the two edges of each leaf.

Figure 6:
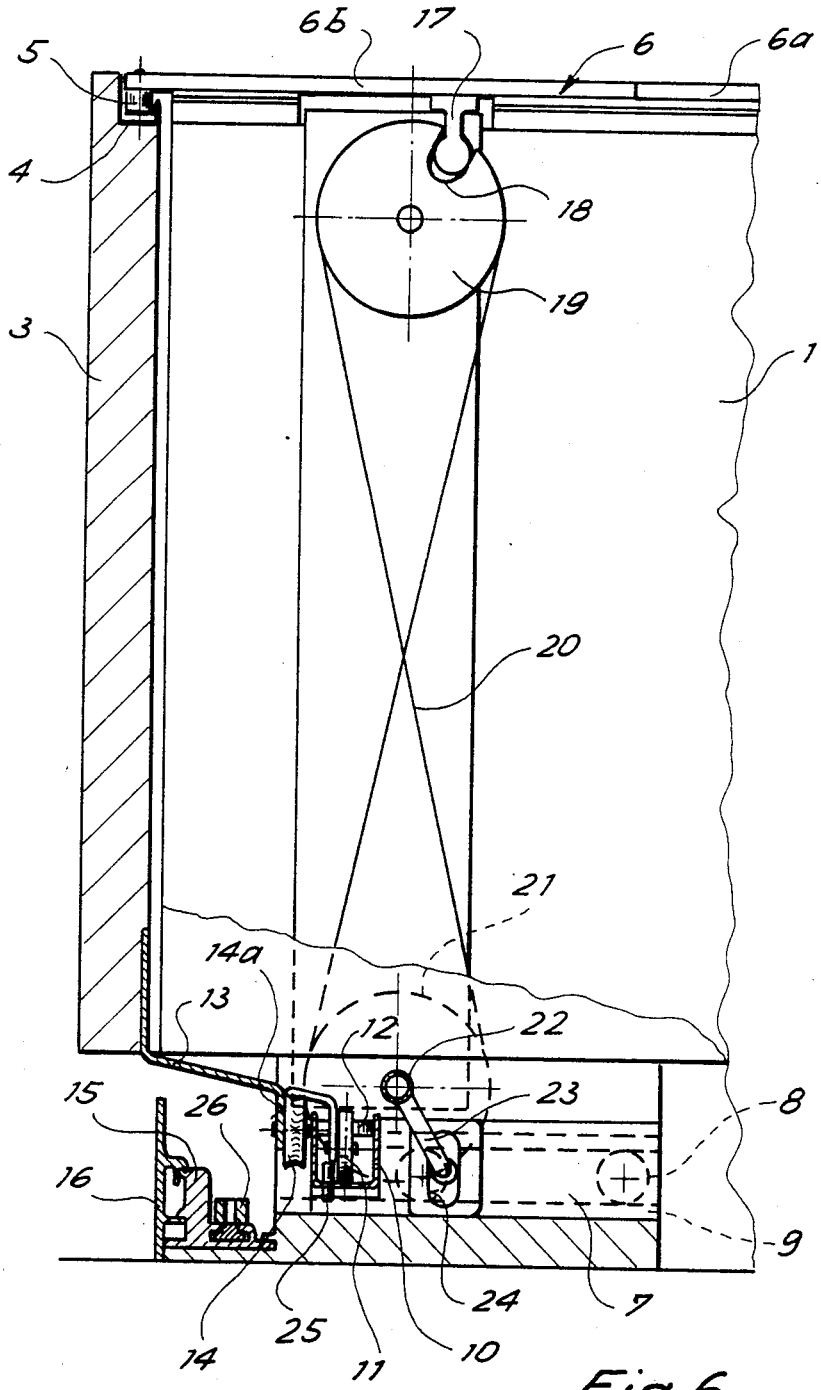
FIG. 6 shows a vertical section through an item of furniture with the leaves aligned in the closed position showing upper and lower parts of the device according to the invention and the connecting element therebetween, located within the side wall.
Figure 11:
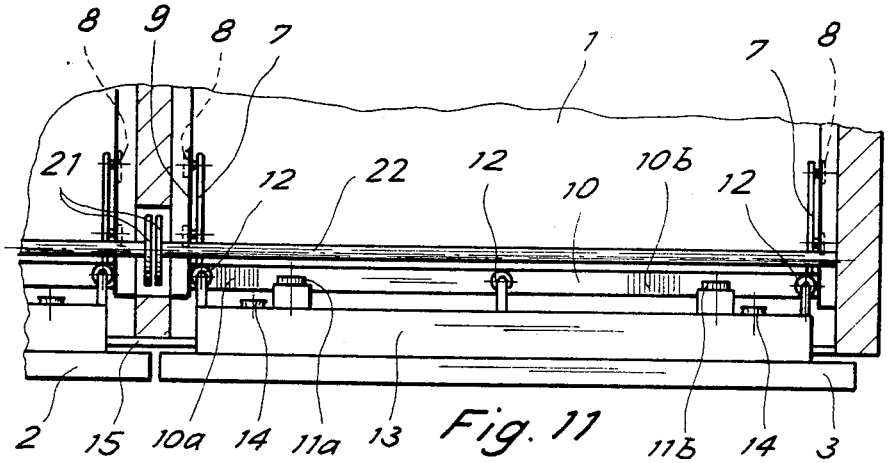
FIGS. 11, 12 and 13 show three different positions of the lower part of the device during the phase of opening towards the left of the right-hand leaf.
Figure 14:
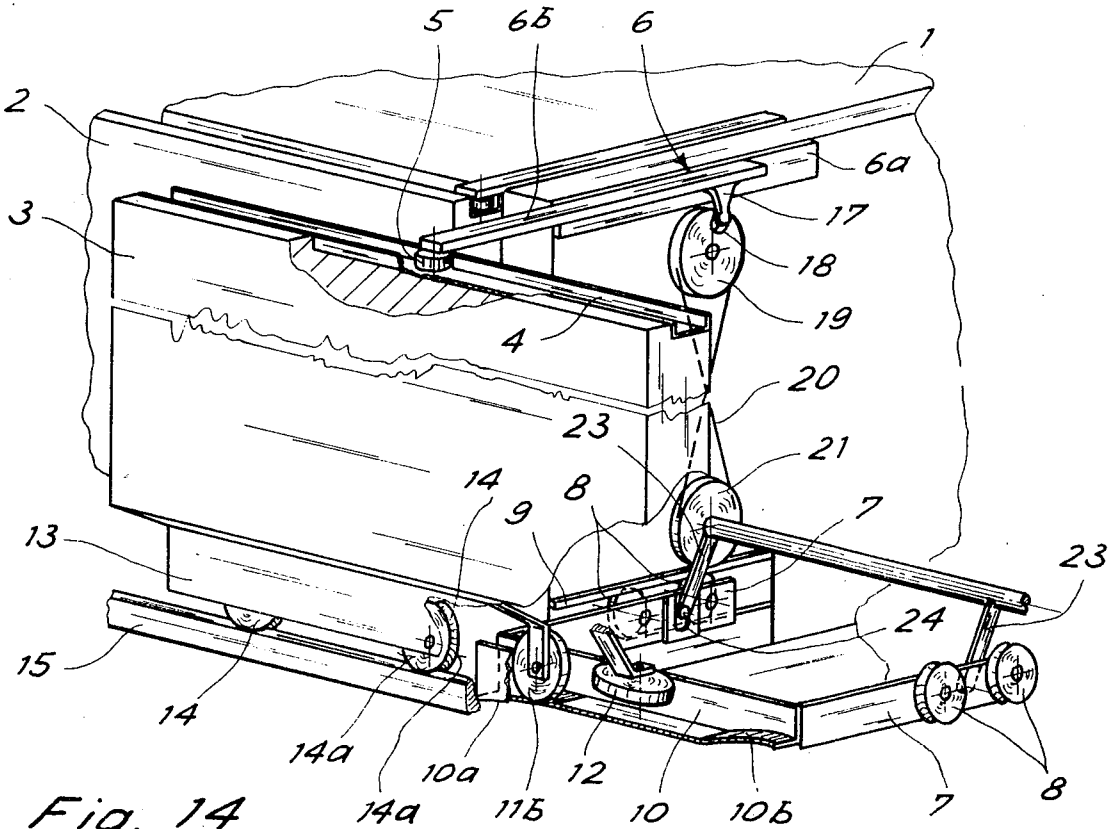
FIG. 14 shows an overall schematic view of the parts for supporting and translating one leaf.

The trolleys 7 carry a U-section slide profile member 10, in which are situated rollers 11 having horizontal axes and rollers 12 having vertical axes, the rollers being rotatably mounted on the lower member 13 of the leaf, as shown in FIGS. 6, 11 and 14. The entire weight of the door leaf 3 can rest upon the slide profile 10 by means of said rollers 11 having horizontal axes.

The lower member 13 of the leaf also carries two grooved rollers 14. In front of the cupboard there is a track 15 extending throughout the entire length of the cupboard front or at least over that part of it equipped with sliding door leaves.

Figure 7:
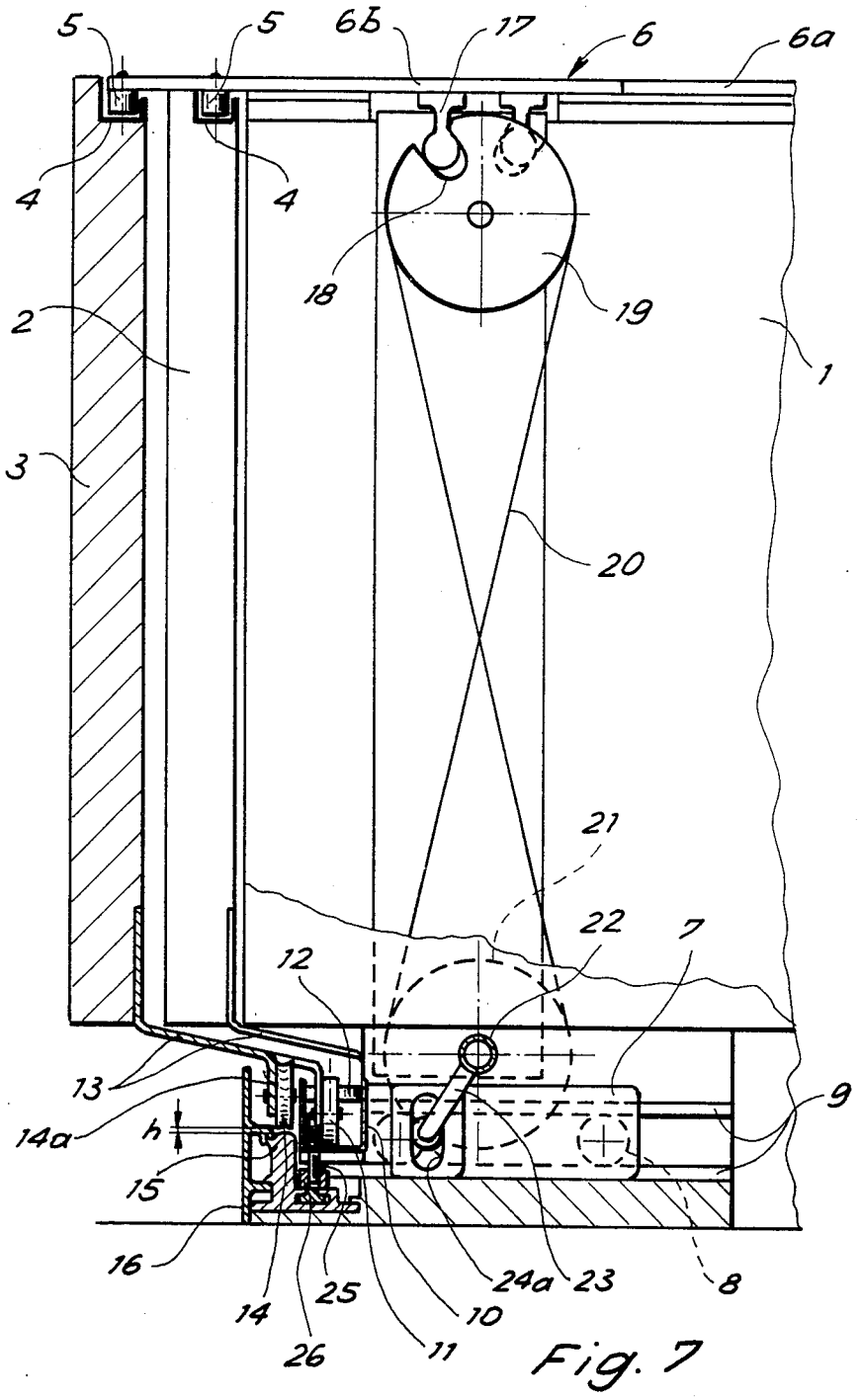
FIG. 7 shows a vertical section through the item of furniture of FIG. 6, with the leaves superimposed in the opening phase.

As shown in FIG. 7, when the rollers 11 rest upon the channel profile 10, the track 15 is separated from the groove of the rollers 14 by a distance "h", which enables the lateral flanges **14*a* (FIG. 14) of the rollers 14** to pass across the track itself.

In front of the track 15 there is provided a covering member 16, mounted on the track 15 by a snap-on system or the like.

As can be seen from FIGS. 6, 7 and 14, a pin 17, which engages into a slot 18 of a rotatable roller 19, is connected to the movable part **6*b* of the slide guide 6. The roller 19 carries a non-stretch, flexible cable 20, which runs around a lower roller 21, which is connected, by means of a suitable tubular transmission shaft 22, to two arms 23 situated near the lateral edges of the leaf 3 and having an end pin engaging in a slot 24 of each of the trolleys 7**.

In this manner the translatory movements of the two trolleys 7 and of the extending guide 6 are rigidly linked and therefore the door 3 always remains in a plane parallel to the plane of its closed position during its movements.

The end of the slide profile member 10 facing towards the translatory side of the leaf 3, opposite the roller **11*a* (FIG. 11), possesses a descending portion 10*a*, the drop of which is greater than the aforementioned value "h"; at the opposite end, in a position opposite the relative roller 11***b*, there is a portion 10*b* rising towards the end of the profile member 10. (See also FIG. 14)

In this case the roller 11*b* is mounted at a higher level than the roller 11*a*.

If translatory movement is desired in both directions, the downward slope 10*a* should be provided at both the ends of the profile 10 and an extensible guide 6 should be provided at each side of the leaf.

The slide profile 10 possesses a movable pin 25, which is retained in a raised position by cam means or the like associated with a roller 11 when the leaf is in the closed position and which is allowed, on the other hand, to descend when the leaf is moved in lateral translatory movement, having been advanced on the trolleys 7.

In association with the pin 25 in the advanced position of the leaf, there is a block 26, having a slot adapted to receive said pin 25 when it is in its lowered position, so as to prevent the return movement of the trolleys 7 when the leaf is laterally translated.

In the example illustrated in FIGS. 1 to 5, an item of furniture having two door leaves is shown, which allows the possibility of either one of these leaves to be opened relative to the other.

In particular in FIGS. 1, 2 and 3, the left-hand leaf 2 which, in the closed position, is aligned with the right-hand leaf 3 (FIG. 1), commences a displacement perpendicular to the external surface (FIG. 2) and, at the end of this displacement, continues with a movement parallel to the external surface and in the direction of alignment of the leaves (FIG. 3), so as to leave free access to the interior of the furniture 1 in the left-hand part of the front surface of the furniture.

In FIGS. 4 and 5, the opening of the right-hand leaf 3 is shown, by means of a displacement towards the left, in such a way as to bring it in superposition upon the left-hand leaf 2 by an operation corresponding to that shown in FIGS. 1 to 3.

FIGS. 6 and 7 show, in particular, the connection obtained by the inextensible, flexible cable 20 between the upper rollers 19 and lower rollers 21, which ensures that the leaves always remain parallel to the vertical front surface of the furniture.

The displacements of the leaves outwards from the furniture are moreover assured at the top by the extending upper guide 6, composed of the fixed element 6*a* and movable element 6*b*, disposed intermediate the two leaves 2 and 3 (FIGS. 8, 9 and 10) and, at the bottom, by the two lateral trolleys 7 equipped with pairs of grooved rollers 8, running on the guide profiles 9 and connected to one another by the U-section member 10.

Figure 12:
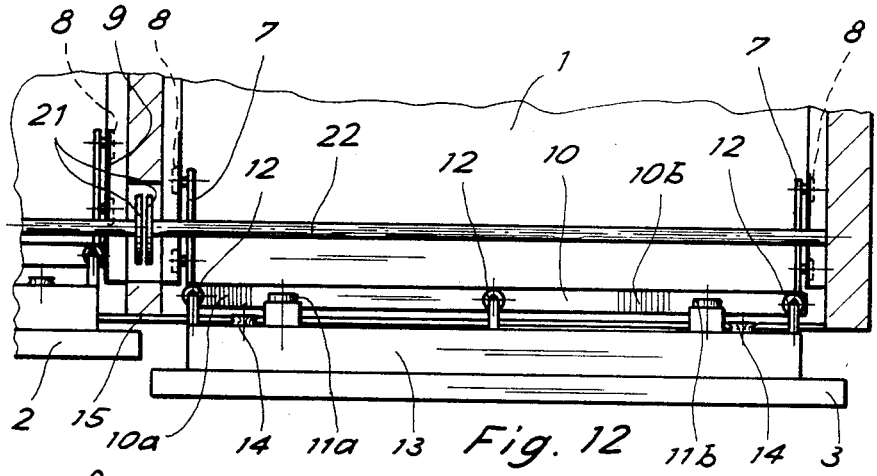
Figure 13:
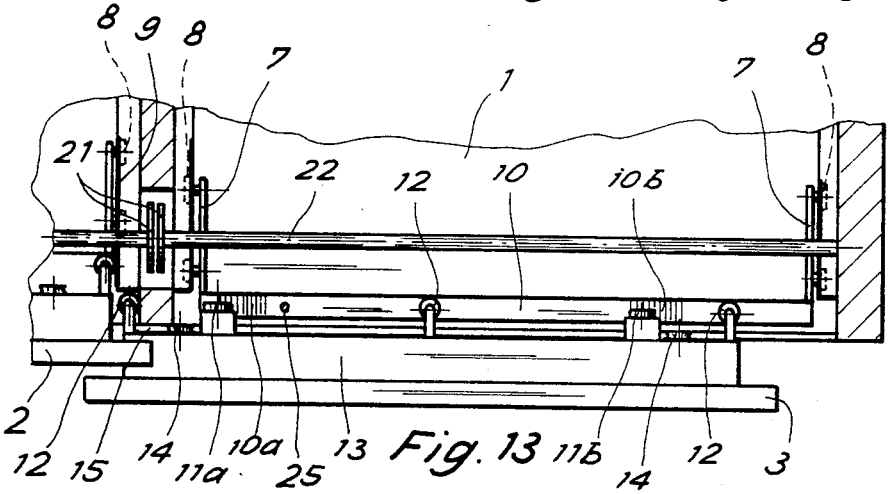

The displacement of the leaves parallel to the front of the cupboard are assured, in the upper part, by the guide composed of the roller 5 having a vertical axis and of the U-section member 4, and in the lower part of the cupboard by the two pairs of rollers 11 and 14 having horizontal axes and running respectively on the U-section member 10 and on the track 15, guided by the three rollers 12 with vertical axes, as visible in plan in FIGS. 11, 12 and 13.

By reference to FIGS. 6 and 7, it is possible to see the displacements and rotations which the various components of the devices undergo during passage from the position of aligned leaves (FIG. 6) to the position of superimposed leaves (FIG. 7), that is to say from the position of closed leaves to open leaves.

In particular in the closed position (FIG. 6), the entire weight of the leaf 3 rests, by way of the lower profile member 13 and the pair of rollers 11, on the U-section member 10.

This distribution of the weight does not undergo variation during the opening phase of the leaf perpendicularly to the front of the furniture.

On the other hand, there will be for displacements of the leaf parallel to the front of the furniture, a progressive shift of the weight of the leaf from the U-member 10 to the track 15.

Such displacement of the weight is due to the slopes which the U-section member 10 possesses at its ends, causing the rollers 11 in contact with it to complete a descent phase. The rollers 11 are mechanically connected to the rollers 14 by way of the lower profile 13 which connects them to the leaf, so that every vertical displacement of the rollers 11 is accompanied by a corresponding vertical displacement of the rollers 14. Thus during the opening displacement of the door leaf parallel to the front of the furniture, a progressive descent of the rollers 11, due to the descent caused by the end slope of the U-section member 10, takes place, which compells an equal descent of the rollers 14 until said rollers 14 come into contact with the track 15, thus causing a shift of the weight of the leaf from the U-section member 10 to the track 15.

The reverse process takes place in the closure phase of the door leaf along a plane parallel to the front of the furniture.

The weight of the leaf shifts from the track 15 to the U-section member 10, the rollers during this displacement being constrained by the end slope of the U-section member 10 to rise, which in turn will cause an equal rise of the rollers 14 relative to the track 15.

The re-entry displacement of the leaf perpendicularly to the front of the furniture 1 is made possible by the transfer of the weight from the track 15 to the U-section member 10 and therefore to the trolleys 7, and finally to the rollers 8 running in the guides 9, and by the disengagement of the rollers 14 from the track 15 which avoids friction between rollers 14 and track 15 in the re-entry phase.

From FIGS. 6 and 7 it will be noted how the inextensible, flexible element 20 locks the rotations of the pulleys 19 and 21 which cause outward movement of the door leaf; at the top by means of the pin 17 rigidly connected to the sliding element 6*b* of the guide 6, to the end of which is connected the vertical-axis roller 5 running in the track 4, and at the bottom by means of the arm 23, which transmits the movement from the tubular shaft 22, engaged by interference in a seating of the appropriate pulley 21 (FIGS. 11, 12 and 13), and transmits it via the slot 24 to the two lateral trolleys 7, supported by the aforementioned pairs of grooved rollers 8 running in the guides 9, and also via the U-section member 10 connecting the trolleys 7, on which rest the horizontal-axis rollers 11 and vertrical-axis rollers 12, integrally connected to the door leaf by the lower profile member 13.

The track 15 and rollers 14 come into operation solely in the opening and closing displacements of the leaf in a plane parallel to the front of the furniture, as explained above. In FIGS. 6 and 7 there can be seen also the cover profile 16 for the lower device, mounted by a snap-on system to the track 15, and the movable pin 25 for blocking the trolleys 7 in the open position of the door leaf. Said pin can be actuated by a cam or the like carried by the profile member 13, in such a way that for all displacements of the leaf parallel to the front of the furniture the group of trolleys 7 with the U-section member 10 always remains blocked by said pin 25. The cam can act on the pin 25 to disengage it from the block 26 mounted on the rail 15 by a reverse process when the leaf is in a position where it can move back perpendicularly to the front of the furniture, that is to say the coupling of the pin 25 to the block 26 will take place in the opening phase of the door leaf, while the cam mounted on the profile 13 moves from the initial exit position perpendicular to the front of the furniture.

Figure 8:
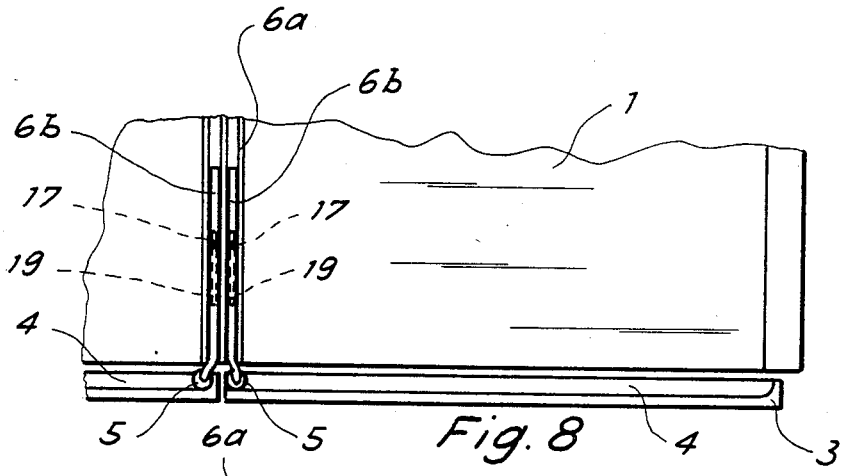
FIGS. 8, 9 and 10 show three different positions of the upper part of the device during the phase of opening towards the left of the right-hand leaf.
Figure 9:
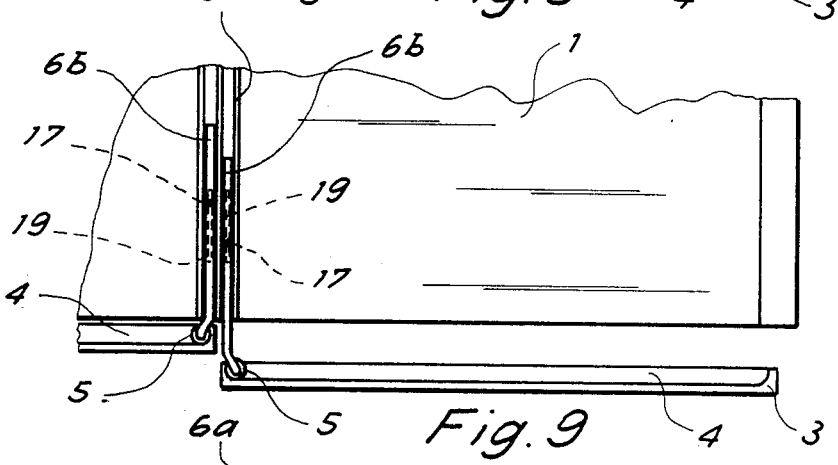
Figure 10:
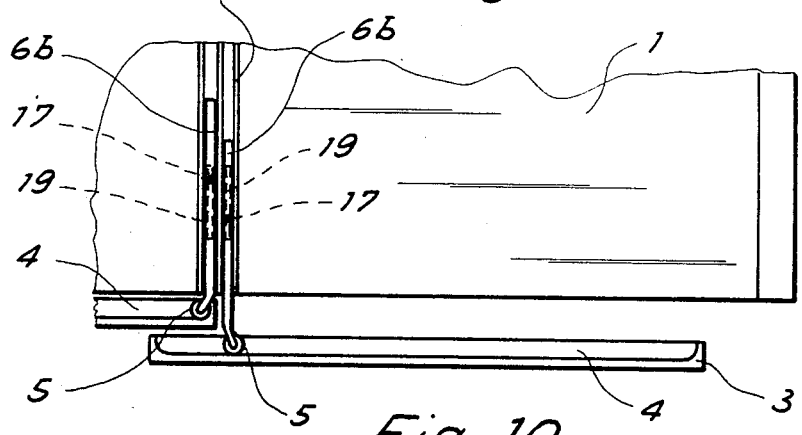

In FIGS. 8 to 10 it is possible to see the upper device of the sliding leaves, in the process of displacement of the right-hand leaf 3 from the closed position (FIG. 8) to the open position along a plane parallel to the front of the furniture (FIG. 10), via a displacement perpendicular to the front of the furniture (FIG. 9).

In particular, FIG. 9 clearly illustrates the movement which the guide **6*b*, linked to the roller 19 by the pin 17, has undergone in the first opening phase perpendicularly to the front of the furniture, bringing the leaf 3 into a plane parallel to but not aligned with that of the door leaf 2, thus permitting the vertical-axis roller 5 to slide freely along the track 4, thereby giving rise to the opening phase parallel to the front of the furniture (FIG. 10**).

Symmetrical displacements of the upper device will evidently take place in the opening phase of the left-hand door leaf 2. In FIGS. 11 to 13, the lower device of the sliding door leaves can be seen, in the same phases of movement of the right-hand door leaf 3 shown in FIGS. 8 to 10 for the upper device.

In particular, FIG. 12 clearly shows the displacement undergone by the U-section member 10, linked to the rollers 21 by way of the tubular shaft 22 and the lateral trolleys 7 supported and guided by the grooved rollers 8.

The displacement perpendicular to the front of the furniture now permits opening displacement of the leaf parallel to the front of the furniture (FIG. 13), the two leaves now being in parallel planes and no longer aligned with each other.

In this way, the weight of the door leaf, initially supported by the rollers 11 resting on the U-section member 10, is transferred to the rollers 14 acting on the track 15, governed by the end slopes **10*a*, 10*b* of the U-section member 10 (and shown hatched in FIGS. 11, 12 and 13) and guided in this displacement parallel to the front of the furniture by the vertical-axis rollers 12 and grooved rollers 14**.

It can be seen (FIG. 13) how the displacement of the left-hand roller 11 will have released the pin 25 to thereby assure blocking of the U-section member 10.

Symmetrical displacements of the lower device will take place in the closure phases of the door leaf 3. Thus, progressive shifting of the weight of the leaf initially supported by the grooved rollers 14 resting on the track 15, to the rollers 11 acting on the U-section member 10, is governed by the end inclined zones of member 10 which the rollers 11 must re-ascend during the closure phase, thus relieving the weight from the grooved rollers 14.

When the door leaf has returned to the position shown in FIG. 12, the pin 25 is disengaged by the cam of the roller 11, and the closure phase of the leaf 3 can be completed by a movement perpendicular to the front surface of the cupboard.

The advantages that can be obtained by the adoption of the device of this invention are evident, which enables the door leaves of the item of furniture to be kept perfectly aligned when in the closed position, permitting, however, a displacement of either one of the door leaves in order to open the relative aperture of the furniture.

The constructive features described and illustrated in the attached drawings will render apparent or suggest various forms, modifications and variations while the essential characteristics of the invention remain unchanged, and without thereby departing from the scope of the patent.

We claim:

1. Apparatus for opening aligned sliding leaves of furniture, comprising an item of furniture with at least two sliding leaves which are aligned in the closed position, wherein the or each sliding leaf comprises an upper track for receiving a roller, a slide guide fixedly secured to or integral with said item of furniture and having a movable part movable in a direction substantially perpendicular to the plane of the leaf and provided with a first roller having a vertical axis received in said upper track and an engagement member, such as a pin, a first pulley coupled to said movable part by said engagement member, a second pulley in a lower part of said item of furniture, an inextensible, flexible element connecting said first and second pulleys, a horizontal shaft extending across the width of said door leaf for supporting said second pulley, an arm extending from each end of said shaft acting upon lateral trolley members supported by pairs of rollers sliding in guides rigidly secured to said item of furniture, said trolleys carrying a substantially U-section member, second rollers having a horizontal axis and third rollers, having a vertical axis and a support member rigidly connecting said second and third rollers to said door leaf whereby said second and third rollers can run in said U-section member, fourth rollers mounted on a support member and arranged, when the leaf is moved perpendicular to said plane and in a direction away from the item of furniture, to cooperate with a horizontal lower track mounted parallel to the front surface of the item of furniture.

2. Apparatus according to claim 1, in which there are a plurality of second and fourth rollers having horizontal axes for carrying the weight of said leaf, and a plurality of first and third rollers having vertical axes for resisting horizontal thrusts and for carrying out the guiding functions in translatory movement phases, said fourth rollers being provided with a peripheral groove with lateral flanges for withstanding horizontal thrusts and for providing a guide for the movement of said fourth rollers when, during the lateral translatory phase, the weight of said door leaf is supported by said grooved fourth rollers resting upon the lower track.

3. Apparatus according to claim 1, in which said inextensible, flexible element links the upper part to the lower part of the apparatus in such a manner that any translatory movement of the movable part of the upper slide guide gives rise to an equal translation of the trolleys, such that during movement of the door leaf the plane of the leaf is substantially parallel to the plane it adopts in the closed position.

4. Apparatus according to claim 3, in which said U-section member is provided, at at least one end, with a descending portion arranged to cause, during lateral translatory opening movement of said leaf parallel to the front surface of said item of furniture, a progressive transfer of the weight of the door leaf itself from the U-section member upon which the second rollers rest, to the lower track, upon which said fourth rollers are brought to bear, and to cause a reverse transfer of said weight during lateral translatory closing movement of said leaf parallel to the front surface of said item of furniture.

5. Apparatus according to claim 3, in which there are a plurality of second and fourth rollers having horizontal axes for carrying the weight of said leaf, and a plurality of first and third rollers having vertical axes for resisting horizontal thrusts and for carrying out the guiding functions in translatory movement phases, said fourth rollers being provided with a peripheral groove with lateral flanges for withstanding horizontal thrusts and for providing a guide for the movement of said fourth rollers when, during the lateral translatory phase, the weight of said door leaf is supported by said grooved fourth rollers resting upon the lower track.

6. Apparatus according to claim 3, in which the translatory movement of the movable part of the upper guide is converted into a rotary movement by means of the engagement member, or pin and the first pulley and is converted back into a translatory movement by means of the second pulley, the shaft and the arms acting, by way of a link slot, on the trolleys.

7. Apparatus according to claim 6, in which said U-section member is provided, at at least one end, with a descending portion arranged to cause, during lateral translatory opening movement of said leaf parallel to the front surface of said item of furniture, a progressive transfer of the weight of the door leaf itself from the U-section member upon which the second rollers rest, to the lower track, upon which said fourth rollers are brought to bear, and to cause a reverse transfer of said weight during lateral translatory closing movement of said leaf parallel to the front surface of said item of furniture.

8. Apparatus according to claim 6, in which there are a plurality of second and fourth rollers having horizontal axes for carrying the weight of said leaf, and a plurality of first and third rollers having vertical axes for resisting horizontal thrusts and for carrying out the guiding functions in translatory movement phases, said fourth rollers being provided with a peripheral groove with lateral flanges for withstanding horizontal thrusts and for providing a guide for the movement of said fourth rollers when, during the lateral translatory phase, the weight of said door leaf is supported by said grooved fourth rollers resting upon the lower track.

9. Apparatus according to claim 1, in which said U-seciton member is provided, at at least one end, with a descending portion arranged to cause, during lateral translatory opening movement of said leaf parallel to the front surface of said item of furniture, a progressive transfer of the weight of the door leaf itself from the U-section member upon which the second rollers rest, to the lower track, upon which said fourth rollers are brought to bear, and to cause a reverse transfer of said weight during lateral translatory closing movement of said leaf parallel to the front surface of said item of furniture.

10. Apparatus according to claim 9 in which, there are a plurality of second and fourth rollers having horizontal axes for carrying the weight of said leaf, and a plurality of first and third rollers having vertical axes for resisting horizontal thrusts and for carrying out the guiding functions in translatory movement phases, said fourth rollers being provided with a peripheral groove with lateral flanges for withstanding horizontal thrusts and for providing a guide for the movement of said fourth rollers when, during the lateral translatory phase, the weight of said door leaf is supported by said grooved fourth rollers resting upon the lower track.

* * * * *